United States Patent [19]

Rebhan et al.

[11] Patent Number: 4,481,737

[45] Date of Patent: Nov. 13, 1984

[54] PIVOTING GATE

[75] Inventors: James R. Rebhan, Onalaska; John C. Rebhan; Arthur Hallstrom, both of LaCrosse, all of Wis.

[73] Assignee: National Enclosure Systems, Inc., Worthington, Ohio

[21] Appl. No.: 599,547

[22] Filed: Apr. 12, 1984

[51] Int. Cl.[3] ..... E05D 7/00

[52] U.S. Cl. ..... 49/385; 49/386

[58] Field of Search ..... 49/131, 33, 385, 386

[56] References Cited

U.S. PATENT DOCUMENTS

| | | | |
|---|---|---|---|
| 800,078 | 9/1905 | Connolly . | |
| 2,542,258 | 2/1951 | Newbold | 49/266 |
| 2,839,852 | 6/1958 | Schloer | 49/386 X |
| 3,839,826 | 10/1974 | Ries | 49/386 X |
| 4,270,312 | 6/1981 | Courtis et al. . | |
| 4,381,626 | 5/1982 | Courtis et al. | 49/386 X |

*Primary Examiner*—Kenneth Downey

*Attorney, Agent, or Firm*—Isaksen, Lathrop, Esch, Hart & Clark

[57] ABSTRACT

A pivoting gate (10) is disclosed which has a rectangular gate frame (11) which is rotated about a horizontal axis by a gate operator (12) from a horizontal closed position to a vertical open position. The torque about the pivot axis is counterbalanced by an opening tension spring (28) when the center of gravity of the gate frame (11) is over the closed position of the gate, and is counterbalanced by one or more closing tension springs (22) when the center of gravity is past the pivot axis and is over the open position of the gate. The closing tension springs (22) are connected to the gate frame at one end and are so attached to the gate operator at their other ends that they will slide freely while the gate is opening but will be held to stretch and apply a counterbalancing torque to the gate frame when its center of gravity is past the pivot axis.

19 Claims, 5 Drawing Figures

PIVOTING GATE

FIELD OF THE INVENTION

This invention relates to the field of gates which can be operated to selectively close an opening, and particularly to large gates of the type used at driveway entrances.

DESCRIPTION OF THE PRIOR ART

Large gates controlling the entrance to property at driveways can be constructed to open in several ways. Gates which swing open about a vertical axis or which are mounted to slide open are perhaps most common at present. However, driveway gates which open vertically by pivoting about a horizontal axis have certain advantages over the horizontally swinging and sliding gates and are becoming more popular. Swinging gates which pivot about a vertical axis on one short side of the gate require a clear area of ground equivalent to the length of the gate to accommodate the gate when it is opened. The opening area must be cleared of tall grass and brush in the summer, or snow in winter, and this area is not available for storage or parking. Sliding gates similarly require ground maintenance to provide a clear path for the gate as it slides open. In contrast, a vertically pivoting gate requires little or no ground maintenance.

Vertically opening, pivoted gates are shown in the U.S. patents to Connolly, U.S. Pat. No. 800,078; Newbold, U.S. Pat. No. 2,542,258; Ries, U.S. Pat. No. 3,839,826; and Courtis, et al, U.S. Pat. No. 4,270,312. Each of these patents shows a spring mechanism which assists in the opening of a gate by counterbalancing the weight of the gate as it opens. The patents to Ries, Courtis, and Newbold also show the use of a spring mechanism to offset the weight of the gate when its center of gravity passes over the pivot point to prevent the gate from slamming open. In the structure shown in the Newbold patent, the offsetting spring is not directly attached to the gate but, rather, is attached through a set of levers and crossbars to balance the weight of the gate in a rather complicated fashion. The patent to Connolly shows a spring directly attached to the bottom of the gate in a horizontal line which primarily serves to assist in the opening of the gate by offsetting the weight of the gate. When the center of the gate passes over the pivot point, a lug engages the counterbalance spring to partially offset the weight of the gate. In the devices of the Connolly and Courtis patents, a single spring is used which is intercepted by a member to change the direction of force applied by the spring to the gate in relation to the location of the center of gravity of the gate with respect to the pivot point. These arrangements can result in wear of the spring elements with extended use.

The device of the Ries patent uses a tension spring for opening assist and a second torsion spring to offset the weight of the gate only when its center of gravity passes over the pivot point. This type of spring structure cannot be readily adapted to function properly with gates of substantially varying sizes and weights, and is subject to unduly rapid fatigue failure. The range of gate travel is also generally limited to less than a full 90°.

The counterbalancing springs required in vertically pivoting gates are subject to fatigue and weakening with extended use and exposure to weather. A weakened counterbalance spring places a greater load on the drive motor, and if the spring is sufficiently weak, the gate may fail to operate. Prior pivoting gates cannot be readily compensated for the effect of spring weakening, and generally a complete replacement of the counterbalance spring mechanism is required to restore proper operation of the gate.

SUMMARY OF THE INVENTION

The pivoting gate of the present invention has a rectangular gate frame which is pivotable about a horizontal axis at a lower corner of the gate frame. The gate includes a gate operator which is readily adapted for use with gate frames of varying sizes and weights. The construction of the gate operator is simple, rugged, reliable over an extended period of use, and can be easily compensated for the effects of counterbalance spring aging and fatigue.

The gate frame is preferably mounted for pivotal motion about a horizontal axis by means of a clutch sleeve, attached to a lower corner of the gate frame, which can be clamped tightly over a pivotally mounted shaft. Torque is applied to the pivot shaft from a drive such as an electric motor connected to the shaft through speed reducing gears. The torque applied about the pivot by the weight of the gate when in its closed position is preferably counterbalanced by an opening tension spring which extends from the base of the gate operator to the upper corner of the gate frame. When the gate frame pivots up to a position where its center of gravity is above or past the pivot axis, the first tension spring applies no more torque to the gate frame. To counterbalance the torque from the weight of the gate frame when its center of gravity is past the pivot axis, at least one closing tension spring is connected from the gate frame (e.g., by connection to a foot member extending from the clutch sleeve) to a sliding connection to the base of the gate operator such that the closing spring exerts no torque on the gate frame until the center of gravity of the gate frame is past the pivot axis and over the open position of the gate. The number of closing springs used can be selected to best match the size and weight of the gate frame. Moreover, additional closing springs can easily be added to increase the counterbalancing torque if the original springs weaken or if attachments are added to the gate frame.

Further objects, features and advantages of the present invention will become apparent from the following description when taken in conjunction with the accompanying drawings.

DESCRIPTION OF THE PREFERRED EMBODIMENTS

Figure 1:
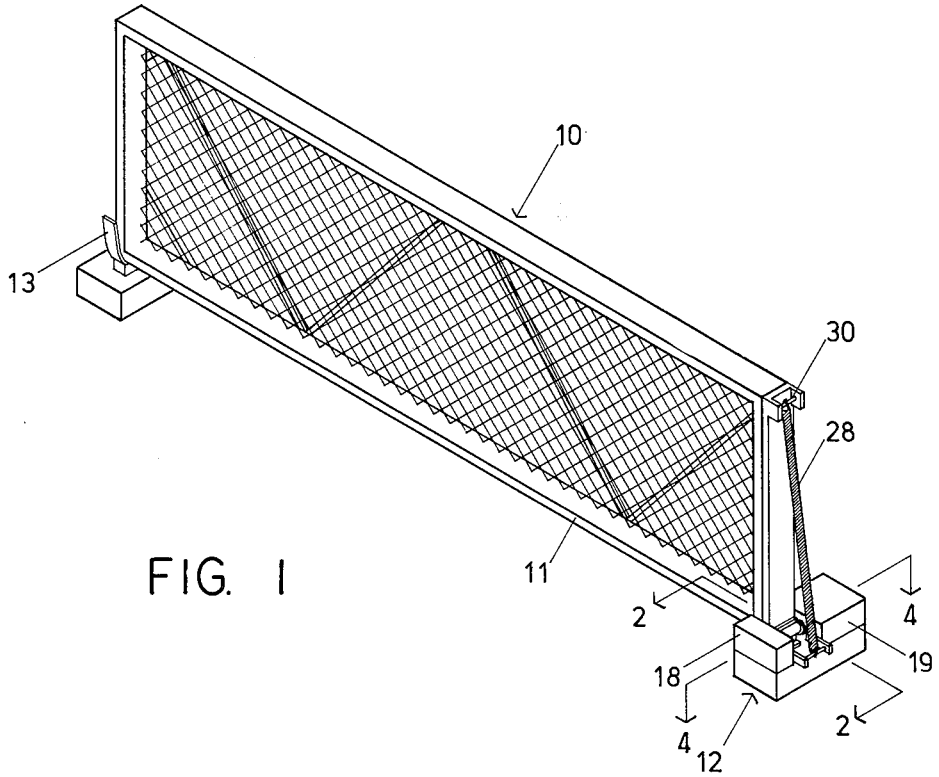
FIG. 1 is a perspective view of the gate of the invention.

With reference to the drawings, a gate in accordance with the invention is shown generally at 10 in FIG. 1. The gate 10 includes a generally rectangular gate frame 11 and a gate operator 12 which can rotate the gate frame 11 from its horizontal closed position, shown in FIG. 1, to an open position in which the gate frame is substantially vertical. As shown in FIG. 1, a yoke 13 preferably engages the end of the gate frame opposite to the end about which the frame is pivoted to stabilize the gate frame when it is closed.

Figure 2:
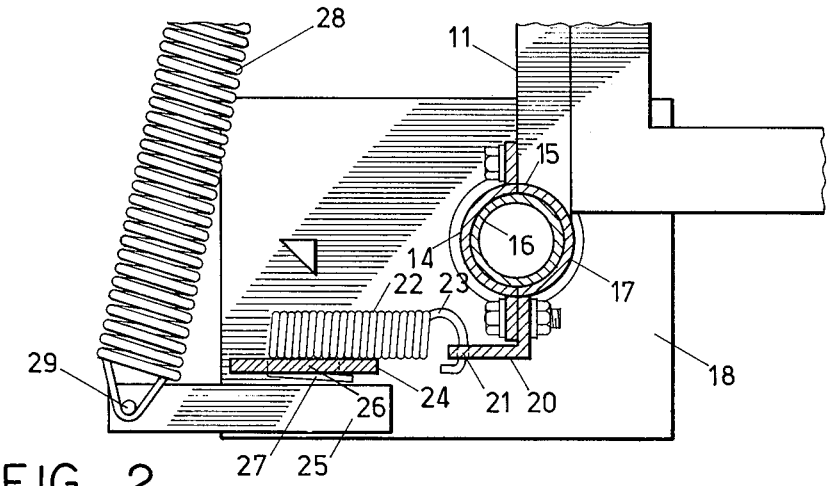
FIG. 2 is a fragmentary cross-sectional view through the gate operator showing a linear tension spring in a plate slot, with the gate closed, taken generally along the line 2—2 of FIG. 1.

The mounting of the gate frame 11 to the gate operator 12 is shown in FIG. 2, which is a sectional view taken along the line 2—2 of FIG. 1 with the gate frame 11 in a closed position. A two part clutch sleeve 14 has one portion 15 attached at its top to a lower corner of the gate frame 11. A horizontal pivot shaft 16 fits snugly between the first clutch sleeve portion 15 and a second portion 17 which is bolted thereto. Frictional engagement between the clutch sleeve 14 and shaft 16 cause the two to rotate together under normal conditions but allows for slippage if the gate frame becomes jammed so it cannot rotate. The pivot shaft 16 is journaled to base supports 18 and 19 (not shown in FIG. 2) for rotation about a horizontal axis. A foot member 20 is attached at one end to the second portion 17 of the clutch sleeve 14, and the foot has an opening 21 at the other end. Several linear closing tension springs 22 each have hooked latches 23 at one end which are inserted into the foot openings 21. Attaching means are provided which are adapted to receive the other end of the linear tension springs 22 so that they can move with the gate frame as it pivots with the shaft 16 without exerting any force on the gate frame until the center of gravity of the gate frame is past the pivot shaft 16. When the center of gravity passes the pivot shaft and is over the open position of the gate (i.e., to the side of the pivot axis away from the area that the gate frame blocks when it is closed), the free end of each closing tension spring is firmly held to cause the closing springs to stretch and exert a counterbalancing torque on the gate frame.

Figure 4:
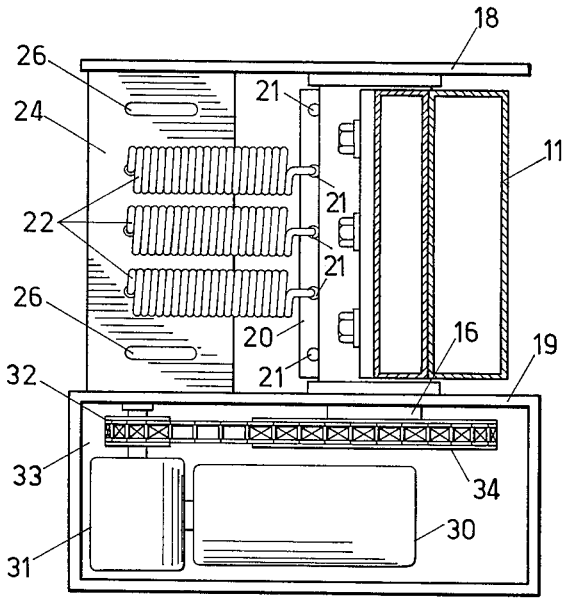
FIG. 4 is a cross-sectional view through the gate operator showing a plurality of linear tension springs in a plurality of slots in a plate, with the gate closed, taken generally along the line 4—4 of FIG. 1.

The attaching means illustrated in FIG. 2 includes a plate 24 which is mounted between the base supports 18 and 19. As best shown in FIG. 4, the plate 24 has a plurality of slots 26 therein extending generally toward the foot member 20, with each slot 26 being adapted to receive a latch member 27 located at the end of each linear tension spring 22, so that the linear tension springs 22 slide through the slot in response to the pivoting of the gate frame 10 from its closed position to a partially open position in which the center of gravity of the gate frame is above the pivot shaft 16. The torque about the pivot axis applied by the mass of the gate frame when its center of gravity is over the closed position of the gate (i.e., to the side of the pivot axis which the gate frame blocks when it is closed) is counterbalanced by an opening tension spring 28 which extends from attachment to a rod 29, connected to the base supports 18 and 19, to attachment to a rod 30 connected to the upper corner of the gate frame 11. The opening spring 28 will be in the fully stretched position when the gate is closed, as in FIG. 1. It should also be apparent that attaching means could mount the springs to the foot member in slots as described above with the other end of the spring being attached to the base support.

It is apparent that a tension spring 22 may be easily inserted into or removed from its position between the foot member 20 and the plate 24 when the gate frame is in the closed position of FIG. 4. The spring 22 can be pulled up to remove the latch 27 from its position in the slot 26 and the spring can then be manipulated until the hooked latch 23 is free of the hole 21 in the foot member. Insertion of new or additional tension springs 22 is simply accomplished by the reverse of the foregoing procedure.

Figure 3:
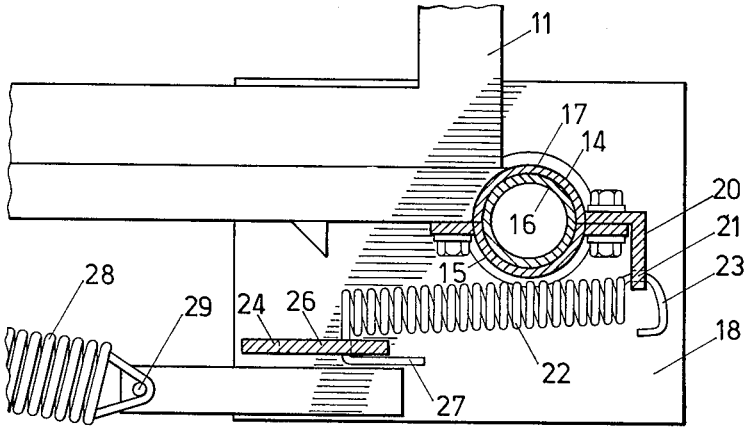
FIG. 3 is a cross-sectional view through the gate operator showing a linear tension spring in a plate slot, as in FIG. 2, but with the gate open.

FIG. 3 shows the gate operator 12 with the gate frame 11 in an open position. The gate can be lifted manually or by a power driver. For example, as shown in FIG. 4, torque may be applied to the shaft 13 by an electric motor 30 driving through a drive train composed of a reduction gear box 31, a sprocket 32, a drive chain 33 engaged to the sprocket 32, and sprocket 34 which is engaged to the drive chain 33 and mounted to the shaft 16. As the gate frame 11 is rotated upwardly, the tension springs 22 move with the gate frame because the latch members 27 are free to move in the slots 26. The tension springs 22 do not exert any force on the gate frame until its center of gravity is past the pivot shaft 16, whereupon the latch members 27 reach the ends of the slots 26. At that point, the linear tension springs 22 stretch as they are pulled by the further turning of the foot member 20 with the clutch sleeve 14.

Figure 5:
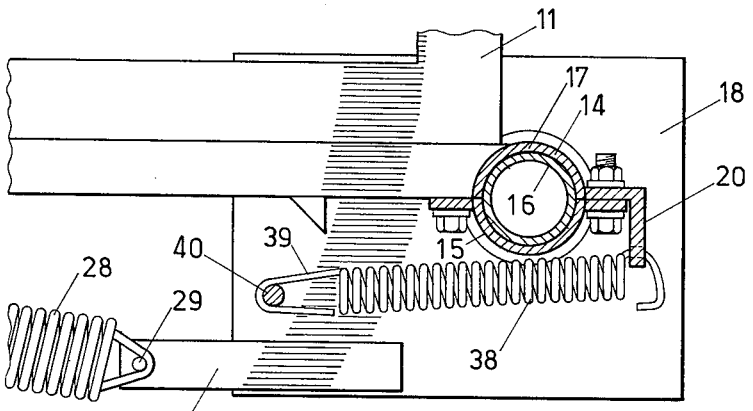
FIG. 5 is a cross-sectional view through the gate operator showing an alternate embodiment of a means to attach the linear tension springs.

FIG. 5 is a cross-sectional view of the gate operator showing another embodiment of a closing tension spring at 38 which is attached to the gate operator base and to the gate frame to apply torque to the gate frame only when its center of gravity is past the pivot axis in the open position. More than one tension spring 38 may be used if desired. The end of each tension spring 22 has an elongated loop which hooks around a pin 40 attached between the base supports 18 and 19. The gate 10 is shown in an open position in FIG. 5, after the gate's center of gravity has passed the pivot axis indicated by the horizontal shaft 16. The pin 40 preferably does not engage the end of the loop 39 until the center of gravity is over the pivot axis; further rotation of the gate frame causes the spring 38 to be stretched between its attachments to the pin 40 and the foot member 20 and thereby to exert a counterbalancing torque on the gate frame.

Flexibility in selecting the size and weight of the gate frame particularly distinguishes the present invention. With the system of linear springs 22 (or 38), any combination of from one to several (e.g., up to five with the plate of FIG. 4) closing tension springs can be used to accommodate gate heights up to eight feet or more. Typical prior gate operators have been designed to operate with a maximum gate height of four feet six inches and cannot accommodate larger and heavier gates. Many government and private industry installations require security fences of eight feet in height. The gate operator of the present invention can be used with such larger gates by increasing the number of closing springs so that the weight of the gate frame can be properly balanced when it is in its vertical open position. It is also apparent that the strength or number of the opening spring(s) 28 can also be selected to best balance the weight of the gate frame when in its closed position.

The instant invention also allows a full 90 degrees gate travel, as illustrated with a comparison of the views of FIGS. 2 and 3, so that the gate is fully vertical when opened, and no portion of the gate overhangs the driveway. This allows vehicles of virtually any height to travel through the access area.

The use of a combination of from one to several tension closing springs also allows finer adjustments of the counterbalancing of the gate weight. Furthermore, less costly motors can be used because the mechanical force required can be supplied by the springs. The linear tension springs used in the present invention for both the opening and closing springs generally have a much longer life than torsion springs. No parts make contact with the body of the springs during the opening and closing of the gate, thereby avoiding a source of wear and possible malfunctions which exist in some prior gate operators. Also, replacement or removal of the opening and closing tension springs 22 (or 38) only requires a few seconds of work, in contrast to the prior gate operators which require disassembly of the unit to enable access to the closing spring.

It is understood that the present invention is not limited to the particular construction and arrangement of parts disclosed and illustrated herein but embraces such modified forms thereof as come within the scope of the following claims.

What is claimed is:

1. A gate operator for a gate of the vertically pivoting type which has a generally rectangular gate frame, comprising:

(a) rotatable pivot mounting means, adapted to be attached to the gate frame at a lower corner thereof, for supporting the gate frame for rotation about a horizontal pivot axis from a horizontal closed position to a generally vertical open postion;

(b) drive means for selectively applying torque to the gate frame to rotate the same between the open and closed positions;

(c) means for counterbalancing a substantial portion of the torque applied about the pivot axis by the weight of the gate frame when its center of gravity is over the closed position of the gate; and (d) means for counterbalancing a substantial portion of the torque applied about the pivot axis by the weight of the gate frame when its center of gravity is over the open position of the gate including:

a base support, a foot member adapted to be connected to the gate frame so as to apply torque thereto, the foot member extending away from the pivot axis and the gate frame, at least one closing tension spring connected at one end to one of the foot member or the base support, and means for selectively engaging the other end of the closing tension spring such that the spring is loose and relaxed when the center of gravity of the gate frame is over the closed position of the gate and firmly holding the end of the spring when the center of gravity of the gate frame is over the open position of the gate such that the spring is stretched and exerts a counterbalancing force on the foot member to provide a torque to the gate frame which counterbalances the torque applied by the weight of the gate frame.

2. The gate operator of claim 1 wherein the means for selectively engaging the closing tension spring includes a plate mounted to the base support having a slot therein extending generally toward the foot member, and wherein the tension spring end has an extending latch member which fits into the slot in the plate and is arranged such that the latch member moves freely in the slot when the center of gravity of the gate frame is over the closed position of the gate and wherein the latch member engages the end of the slot to hold the tension spring so that it will stretch when the center of gravity of the gate frame is over the open position of the gate.

3. The gate operator of claim 2 wherein the plate has a plurality of slots extending toward the foot member and including a plurality of tension springs each connected to the foot member at one end and extending substantially parallel to one another and having latch members which each engage in one of the plurality of slots in the plate.

4. The gate operator of claim 3 wherein the closing tension springs are adapted to be individually inserted and removed from engagement with the plate and from attachment to the foot member to allow selective addition and subtraction of tension springs.

5. The gate operator of claim 1 wherein the means for selectively engaging the closing tension spring includes a pin mounted to the base support extending substantially perpendicular to the tension spring and wherein the tension spring has an elongated loop portion which encircles the pin such that the tension spring can be moved toward and away from the pin for a substantial distance before the pin engages the loop to hold the tension spring and cause it to stretch when the center of gravity of the frame member is over the open position of the gate.

6. The gate operator of claim 5 wherein a plurality of closing tension springs are mounted between the foot member and the pin.

7. The gate operator of claim 1 wherein the pivot mounting means includes a pivot shaft mounted for rotation about a horizontal axis, a clutch sleeve frictionally engaged with the pivot shaft and adapted to be connected to the gate frame, and wherein the foot member extends from the clutch sleeve.

8. The gate operator of claim 7 wherein the drive means includes an electric motor supplying torque to the pivot shaft.

9. A gate of the vertically pivoting type comprising:

(a) a generally rectangular gate frame;

(b) rotatable pivot mounting means, attached to the gate frame at a lower corner thereof, for supporting the gate frame for rotation about a horizontal pivot axis from a horizontal closed position to a generally vertical open position;

(c) drive means for selectively applying torque to the gate frame to rotate the same between the open and closed positions;

(d) means for counterbalancing a substantial portion of the torque applied about the pivot axis by the weight of the gate frame when its center of gravity is over the closed position of the gate; and (e) means for counterbalancing a substantial portion of the torque applied about the pivot axis by the weight of the gate frame when its center of gravity is over the open position of the gate including:

a base support, a foot member connected to the gate frame extending away from the pivot axis and the gate frame, at least one closing tension spring connected at one end to one of the foot member or the base support, means for selectively engaging the other end of the closing tension spring such that the spring is loose and relaxed when the center of gravity of the gate frame is over the closed position of the gate and firmly holding the end of the spring when the center of gravity of the gate frame is over the open position of the gate such that the spring is stretched and exerts a counterbalancing force on the foot member to provide a torque to the gate frame which counterbalances the torque applied by the weight of the gate frame.

10. The gate of claim 9 wherein the means for selectively engaging the closing tension spring includes a plate mounted to the base support having a slot therein extending generally toward the foot member, and wherein the tension spring end has an extending latch member which fits into the slot in the plate and is arranged such that the latch member moves freely in the slot when the center of gravity of the gate frame is over the closed position of the gate and wherein the latch member engages the end of the slot to hold the tension spring so that it will stretch when the center of gravity of the gate frame is over the open position of the gate.

11. The gate of claim 10 wherein the plate has a plurality of slots extending toward the foot member and including a plurality of tension springs each connected to the foot member at one end and extending substantially parallel to one another and having latch members which each engage in one of the plurality of slots in the plate.

12. The gate of claim 11 wherein the closing tension springs are adapted to be individually inserted and removed from engagement with the plate and from attachment to the foot member to allow selective addition and subtraction of tension springs.

13. The gate operator of claim 9 wherein the means for selectively engaging the closing tension spring includes a pin mounted to the base support extending substantially perpendicular to the tension spring and wherein the tension spring has an elongated loop portion which encircles the pin such that the tension spring can be moved toward and away from the pin for a substantial distance before the pin engages the loop to hold the tension spring and cause it to stretch when the center of gravity of the frame member is over the open position of the gate.

14. The gate of claim 9 wherein a plurality of closing tension springs are mounted between the foot member and the pin.

15. The gate of claim 9 wherein the pivot mounting means includes a pivot shaft mounted for rotation about a horizontal axis, a clutch sleeve frictionally engaged with the pivot shaft and adapted to connect to the gate frame, and wherein the foot member extends from the clutch sleeve.

16. The gate operator of claim 7 wherein the drive means includes an electric motor supplying torque to the pivot shaft.

17. A pivoting gate, comprising:

(a) a generally rectangular gate frame;

(b) a clutch sleeve attached to one lower corner of the gate frame;

(c) a horizontal pivot shaft snugly and frictionally engaged in the clutch sleeve and extending perpendicular to the gate, the pivot shaft being mounted for rotation;

(d) drive means for rotating the pivot shaft;

(e) a foot member attached to one end of the clutch sleeve and extending away therefrom;

(f) a plurality of closing tension springs each latched at one end to the foot member;

(g) attaching means adapted to receive the other end of the closing tension springs in a way so that the tension springs can move with the gate frame as it pivots about the pivot shaft without exerting any force on the gate frame until the center of gravity of the gate frame is at a position above the pivot shaft, whereafter the closing tension springs are held to stretch and exert a counterbalancing torque on the gate frame; and (h) means for counterbalancing a substantial portion of the torque applied about the pivot axis by the weight of the gate frame when its center of gravity is over the closed position of the gate.

18. The gate of claim 17, wherein the attaching means adapted to receive the other end of the linear tension springs is a plate mounted on a base support and having a plurality of slots therein, wherein each closing tension spring has an extending latch member and each slot is adapted to receive the latch member so that the tension springs slide in the slots in response to the pivoting of the gate frame about the pivot shaft until the center of gravity of the gate frame is above the pivot shaft.

19. The gate of claim 17 wherein the attaching means adapted to receive the other end of the tension springs includes a pin attached to a base support and wherein the tension springs each have an elongated loop portion which encircles the pin such that the tension springs can be moved toward and away from the pin for a substantial distance before the pin engages the loop to hold the tension spring and cause it to stretch when the center of gravity of the frame member is over the open position of the gate.

* * * * *